US005741130A

United States Patent [19]

Hagstrom et al.

[11] Patent Number: 5,741,130

[45] Date of Patent: Apr. 21, 1998

[54] METHOD AND APPARATUS FOR MINIMIZING DISRUPTION CAUSED BY DEPOSITIONS ON A SUPPLY MEANS FOR A COMBUSTION OF GASIFICATION PLANT

[75] Inventors: Ulf G. Hagstrom, Ekerö; Eric W. Norelius, Enskede, both of Sweden

[73] Assignee: Ecological Combustion i Stockholm AB, Sodertalje, Sweden

[21] Appl. No.: 505,221

[22] PCT Filed: Jun. 4, 1993

[86] PCT No.: PCT/SE93/00499

§ 371 Date: Nov. 30, 1994

§ 102(e) Date: Nov. 30, 1994

[87] PCT Pub. No.: WO93/25850

PCT Pub. Date: Dec. 23, 1993

[30] Foreign Application Priority Data

Jun. 5, 1992 [SE] Sweden ..... 9201747

[51] Int. Cl.[6] ..... F24D 5/00; F28G 1/02

[52] U.S. Cl. ..... 432/2; 432/75; 122/380; 122/384; 122/390; 110/212

[58] Field of Search ..... 122/380, 384, 122/390, 395; 432/2, 75; 15/88, 88.2, 256.53

[56] References Cited

U.S. PATENT DOCUMENTS

| | | | |
|---|---|---|---|
| 884,728 | 4/1908 | Gray | 122/384 |
| 2,225,200 | 12/1940 | Ames | 15/88 |
| 4,883,003 | 11/1989 | Hoskinson | 110/212 |
| 5,065,472 | 11/1991 | Carpenter et al. | 122/390 |
| 5,197,837 | 3/1993 | Brown | 15/88.2 |

FOREIGN PATENT DOCUMENTS

| | | |
|---|---|---|
| 0286077 | 4/1988 | European Pat. Off. . |
| 107755 | 2/1899 | Germany . |
| 45212 | 6/1916 | Sweden |
| 115046 | 9/1945 | Sweden |
| 139072 | 2/1953 | Sweden |
| 139563 | 3/1953 | Sweden |
| 458147 | 2/1989 | Sweden |
| WO9100134 | 1/1991 | WIPO |

*Primary Examiner*—Henry A. Bennett
*Assistant Examiner*—Jiping Lu
*Attorney, Agent, or Firm*—Sughrue, Mion, Zinn, Macpeak & Seas, PLLC

[57] ABSTRACT

A method and apparatus for minimizing disturbances caused by depositions on a feeding apparatus for a combustion or gasification plant. Secondary air is fed via perforated tubes 13 which by affecting the emission levels of the process with longer or shorter time intervals are inserted and withdrawn from the chamber, while being cleaned from slag, dust and other deposits outside the chamber by wire brushes 21. The combustion process may continue by using the remaining tubes while one or more are being cleaned.

11 Claims, 2 Drawing Sheets

1
2
3
4
5
6
10
10'
11
11'
12
12'
13
13'
14
15
16
17
20
21
23
25
28
29
40
41
42
43
II

METHOD AND APPARATUS FOR MINIMIZING DISRUPTION CAUSED BY DEPOSITIONS ON A SUPPLY MEANS FOR A COMBUSTION OF GASIFICATION PLANT

FIELD OF INVENTION

With different types of actual combustion and gasification processes there exists an increasing demand for quality and quantity gas analysis. Nitrogen oxides are at present the most exposed flue gas components, especially when considering tariff which has been introduced in Sweden for plants larger than 10 MW and with an annual energy production greater than 50 GWh.

These effect and energy limits, respectively, will most probably be reduced while at the same time greater demands will be made on the measurement of other types of flue gas components, i.e. CO and $N_2O$ (laughing-gas).

The large majority of existing combustion systems are so designed that a minimum quantity of all unwanted flue gas components is very difficult to attain simultaneously. In other words "compromise agreements" e.g. high CO-concentrations—low NO-concentrations are unavoidable in these systems.

The fuel composition often varies from one operational condition to another, particularly with regard to different types of waste fuels and also wood fuels.

Examples of ash and/or slag enriched fuels comprise wood fuels, straw, waste such as industrial, municipal, hazardous and hospital waste and also hard coal, lignite, peat, lime sludge and black liquor. Also crematories and cement kilns are included in this category of combustion/gasification systems.

"Ash" is a term which designates an inorganic and unburnable substance which is originally within the fuel.

"Slag" is a term which designates "additives" of inorganic and unburnable substances, such as metals, ceramics, glass, stone etcetera. "Ash" is often considered contained within the term "slag".

Fuel price is another important parameter for optimization of flue gas or gas parameters. Sulphur content and to a certain degree also nitrogen content in the fuel are directly proportional to the emission level ahead of a flue gas cleaning system. This of course has the consequence that the fuel price becomes higher when i.e. the nitrogen content in the fuel is higher. Of course also the economical result is influenced by the market price and this will sometimes change quickly.

Trade in emission rights according to so called bubble models are systems which are expected to have a breakthrough on the market in the future.

The above parameters show a future need of flexible combustion/gasification systems which can be quickly adjusted to attain an optimal economical operation point on each occasion.

When using an optimization of this kind the perforated tubes in the combustion or gasification chamber are fed by a fluid comprising a gas or a liquid or possibly solid particles. Examples of gas are air, oxygen, oxygen-enriched air, flue gas, inert gas ($CO_2$, $N_2$ etc), fuel for reburning (LP-gas, natural gas etc) $NO_x$ reducing substances ($NH_3$, urea etc) and steam with an optimal flow, pressure and temperature.

Examples of liquids are water, $NH_3$, urea etc. Examples of solid particles are powder from biofuel including peat, coal and waste (plastic etc). These can be used as a reburning fuel.

Actual oxidizing agents, e.g. air, shall oxidize unburnt gases, e.g. CO, while reducing agents, e.g. $NH_3$ or for example LP-gas, shall reduce for example NO at different occasions in a desired optimal degree.

The tube or the tubes is/are suitably positioned in the combustion/gasification plant to give an optimal effect.

In for example a grate fired boiler with "over combustion", where the air beneath the fuel makes the flue gas move upwards, the tube or tubes can be placed over the grate in connection with the first draught of the boiler. For a combustion process with so called "under combustion" the reverse will apply.

In for example a fluidized bed with variable pressure the tube or tubes can be positioned in the combustion chamber.

BACKGROUND ART

Today combustion/gasification of ash and slag enriched fuels takes place in a variety of different apparatus and plants in the form of kilns, furnaces etc with burners, grates, fluidized and/or bubbling beds etc.

One characteristic of kilns and furnaces such as these is that the flue gas emissions of CO, $C_xH_y$ (hydrocarbons), $NO_x$, $SO_2$, $N_2O$, dioxine, PAH among others often are high due to poor combustion optimized plants.

Some plants are also equipped with different types of flue gas cleaning systems, e.g. electrostatic precipitators or textile filters, SCR, scrubbers etcetera which are positioned after the combustion/gasification apparatus, which reduces the emission level in the subsequent stack/gas channel.

As an example of well known apparatuses to minimize emission levels EP-O 286 077 A2 (Müllverbrennungsanlage Wuppertal) describes a method of burning waste in which the flue gas is drawn out of the furnace and made to make a swirling movement by the addition of secondary air. The secondary air is fed through nozzles in such a way that the flow of flue gases is slowed down in a uniform temperature zone in the furnace and then allowed to remain there for approximately 8 seconds.

SE.C.139 072 (Larsson) describes a furnace, especially in a heating boiler or for connection to similar boilers' fire rooms in which intakes for the primary air are located on the side of the furnace, said intakes leading to one or several fixed tubes along the furnace, which in their turn contain a rotatable tube which regulates the outlet area for air by twisting the tube about its axis and/or axial shifting of the tube.

DE.C.107 755 (Lindemann) describes an apparatus for supplying air over a layer of fuel, which apparatus has a tube grid with a net-like arrangement of tubes, one over the other and with openings pointing to the side so that several air jets cross one another.

SE.C.115 046 (Sinding) describes an apparatus for preheating and adjusting the supply of secondary air to furnaces, which apparatus is furnished with concentric tubes positioned close together and extending into a preheating chamber to supply air to the chamber and are mutually rotatable so that its openings can be set at an angle to one another for the adjustment of the area of passage and thereby the air supply.

Feeding apparatuses in the shape of a perforated tube which injects into a combustion chamber are known, for example through WO-A1-91/00134 (Fuel Tech Europe), U.S. Pat. No. 4,883,003 (Hoskinson) and SE.C.139 563 (Svenska Maskinverken).

Further examples of prior art are to be found in SE.C.45 212 (Reck) and SE.B.458 147 (Lantmännen ODAL).

All such known combustion and gasification plants, have the disadvantage that serious disturbances occur due to the fact that the tubes which are positioned in the combustion or gasification chamber become coated with ash, slag, unburnt material, soot etcetera, and the combustion or gasification process cannot be run continually without periodically cleaning the tubes, whereby the process must be stopped. This procedure is tedious, expensive and may in some cases make an acceptable operation impossible, especially when burning slag enriched fuels, like waste. Besides this, it/they has/have both a flow pattern and a combustion technical disturbing effect when optimizing flue gas or gas parameters in a plant of the mentioned type.

OBJECTS OF INVENTION

One object of the invention is to minimize the above mentioned disturbances in known methods of combustion and gasification including associated plants, thereby increasing the efficiency and reducing the emission levels in the combustion and gasification processes, respectively.

Another object is to increase the flexibility of the method and the plant in order to, if so required, make possible a quick and simple adjustment from one desired emission level (e.g. high CO- low NO-concentration) to another (e.g. low CO- high NO-concentration) depending on the economical output.

Yet another object is to achieve a method of minimizing disturbances and a feeding apparatus, respectively, which simplifies and cheapens cleaning of the tubes, thereby achieving an increased yield of the combustion and gasification processes, respectively.

Another object is to accomplish a method and a plant, respectively, which renders it possible to continuously or at least almost continuously operate the combustion process, i.e. without having it to be stopped for soot removal or cleaning of the tubes, respectively, feeding for example secondary air, and being contained in the combustion or gasification chamber, respectively.

SUMMARY OF THE INVENTION

The invention affords the possibility of a more effective combustion or gasification operation due to the fact that disturbances caused by depositions on the feeding apparatus can be minimized or mainly totally avoided.

The invention also simplifies dust removal and the cleaning procedure of the tubes which in turn increases the efficiency of the combustion and the gasification operation, respectively.

It is especially important that the area where the tube is perforated is kept clean. This is effectively ensured when the cleaning operation is carried out with a simultaneous axial displacement movement of the tubes.

When the method is applied in practice, suitably formed brushes or scrapers can be arranged outside the chamber to engage the, tube. When the tube is moved in or out these brushes or scrapers contribute to free the tube from dust and other deposits.

Different types of soot removal and cleaning devices can be made use of when the invention is put into practice. For example a vibration means either just mechanical or with infra- or ultrasound may engage the tube while leaving or having left the chamber. It is also possible to clean the tube or tubes manually.

It is perceived that this type of method will considerably increase the efficiency of the process in a combustion and a gasification plant, respectively.

Output signals from different transmitters, e.g. for temperature, pressure, flow, existing flue gas components etcetera, can be used for determining initiation of cleaning operations.

These signals can also be used for the adjustment of the supply of fluid and solid particles to the tubes. Said supply may occur by blows, or intermittently, possibly at different angles.

In general use the inventive method can be put into practice on existing as well as new combustion/gasification plants. New boilers and furnaces, respectively, can be constructed with a smaller volume of furnace due to a more effective mixing of the gases, which reduces costs.

The best operation possible with optimal emission level at every separate occasion can more simply be obtained than with systems known heretofore.

Cooling fluid can possibly be supplied separately but preferably via a ring column around each tube. Due to the cooling, slag and other dust deposition on the tubes become less glass-like or sticky whereby the cleaning operation will be simplified and speeded up.

By undertaking rapid cooling of the tube, shrinkage of the tube will occur causing heavy depositions to crack and loosen.

The invention also refers to a feeding apparatus for a combustion or gasification plant for minimizing disturbances caused by depositions on the tubes and also to optimize the flue gas or gas parameters.

Further characteristics and advantages, respectively, of the method and the feeding apparatus according to the invention will be given in the following description of some preferred embodiments of the invention.

DESCRIPTION OF PREFERRED EMBODIMENTS

Figures 1, 2A:
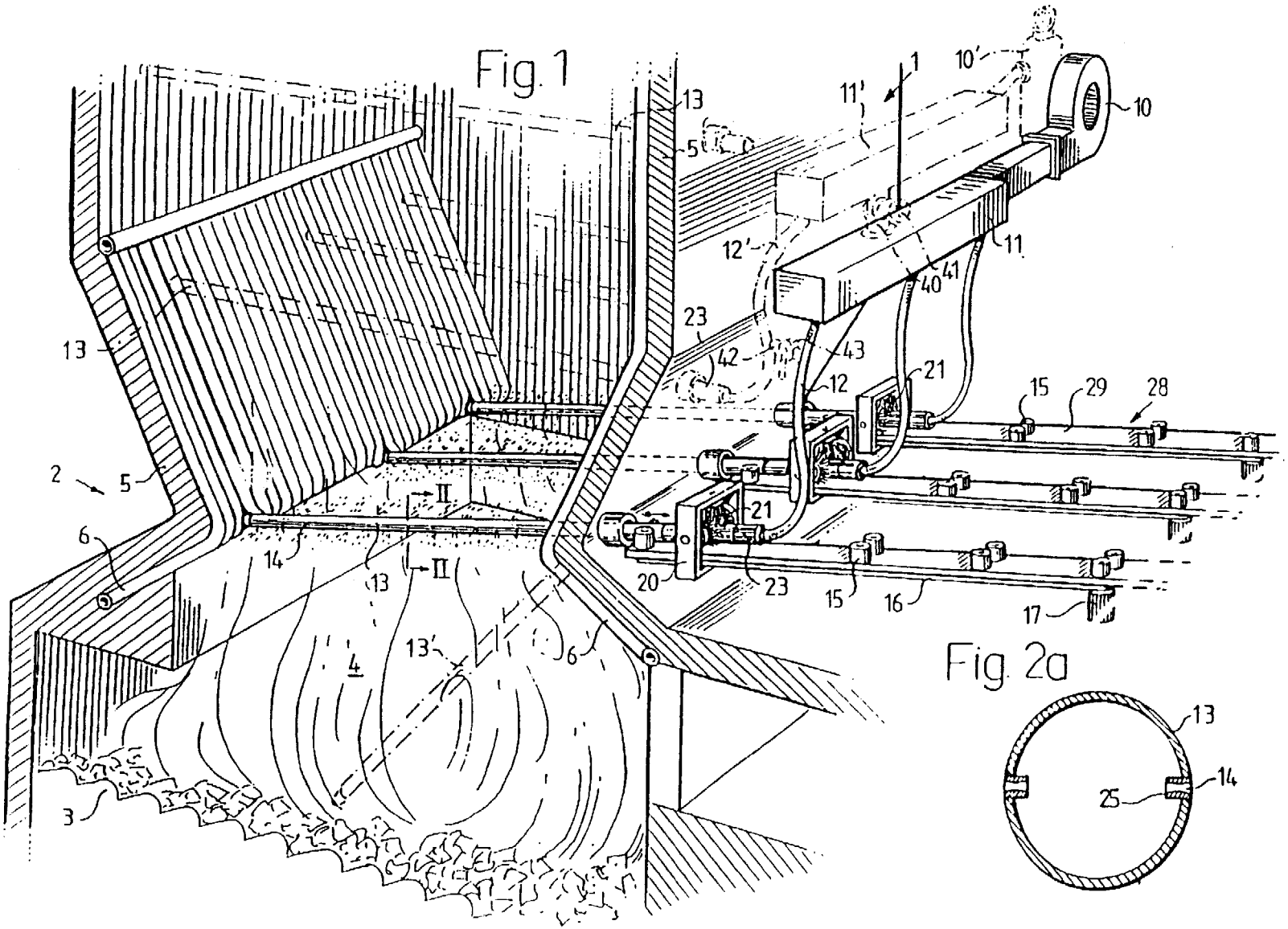
FIG. 1 is a partly cut-away perspective view of a combustion plant for solid fuels having a feeding apparatus in accordance with the invention, FIGS. *2a–2d* are sectional views along the line II—II in FIG. 1 and show different examples of feeding tubes in the apparatus for different fluids such as secondary air and solid particles, respectively.

In FIG. 1 the digit 1 denotes a device for optimizing flue gas parameters in a combustion plant 2. The application comprises a number of feeding apparatuses to the plant which are arranged for minimizing disturbances caused by depositions. The combustion plant comprises a furnace for combustion of solid fuels with a grate 3 and an upper combustion chamber 4.

The fuel can be fed intermittently or continuously and combustion air in the form of primary air is blown from below and up through the grate 3.

Secondary air is fed through special ports in the furnace wall in order to complete the combustion of formed reaction products in the shape of gas and solid particles.

Particles in the flue gas above the grate 3 consist of ash, slag and/or unburnt fuel. These can together form bigger particles, so called agglomerates, or be reduced to smaller, more or less clean ash particles. Slag enriched fuels often give higher concentrations of dust and slag in the flue gas.

Some of the particles form deposits on the inside of the combustion chamber which is often equipped with tubes 6 with an external insulation 5. Dust particles also deposit on the tubes 13 where the holes 14 for feeding secondary air are entirely or partially blocked thereby affecting the feed of secondary air, alternatively coating will occur directly on the mantle of the tube. This causes an incomplete combustion which is not optimal with further inherent problems of the mentioned type.

Poor mixing conditions in the gas chamber of this kind render the combustion plant a lower combustion efficiency. This especially occurs when steps are taken to reduce $NO_x$ when concentrations of unburnt gases/particles are higher than before the adjustment. Throttling down air supply and/or flue gas recirculation reduces the temperature in the combustion zone and, further, creates reducing conditions which lead to lower $NO_x$ concentrations and higher concentrations of unburnt gases and particles. The demand for efficient admixing of secondary air becomes even more important which in turn leads to a demand of frequent cleaning or soot removal of the secondary air tubes.

In plants previously known the combustion process has to be stopped in order to perform such soot removal or cleaning.

Figure 2B:
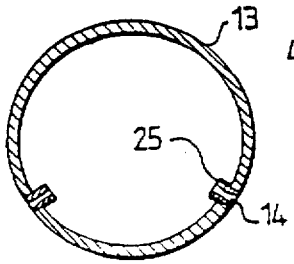
Figure 2C:
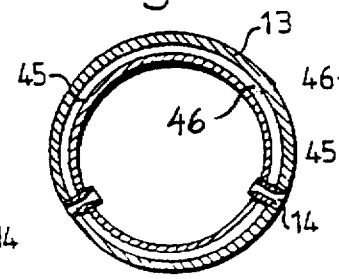
Figure 2D:
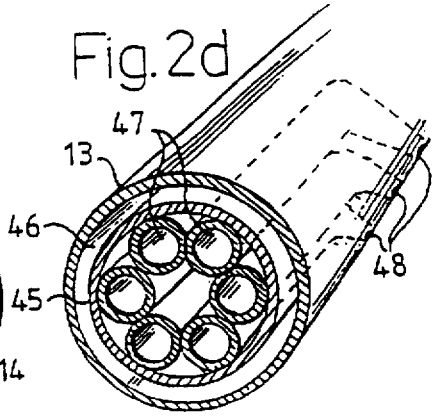

In the plant shown in FIG. 1 the feeding tubes 13 for a fluid, e.g. secondary air, are arranged forming a curtain system comprising a number of tubes 13, some of which are parallell, at one or more levels in the combustion chamber 4. The tubes 13 are equipped with perforations 14, according to FIG. 2 shaped as nozzles 25, alongside the mantle surface of the entire tubes. The holes can be divided equally and a row of holes can be positioned on each side of the tube. Alternatively the angle can be varied both "upwards" and "downwards", e.g. as shown in FIG. 2*b*. Cross sections through two other appropriate types of tubes are shown in FIGS. 2*c* and 2*d*.

The outlet area of the holes determines the flow of the fluid at a given pressure. When the speed profile over the actual cross section in a combustion or gasification plant, where the apparatus shall be installed, often varies, a compensation must be made when feeding the fluids.

A fluid, e.g. secondary air at high pressure, is fed via a fan 10 connected to a collecting box or plenum 11, to which flexible tubes 12 are connected, which with quick-couplings 23 are connected to the end, of the tubes 13. The opposite ends of the tubes can be plugged.

Depending on the actual combustion process the tubes 13 are inserted and withdrawn from the chamber 4 in an axial direction at longer or shorter periods of time. In such a way the emission level of the combustion process can be maintained optimal.

In order to minimize disturbance causing deposits on the tubes and to make a quick and simple cleaning of dust and other particles from the tubes, which cause a plugging of the holes 14 or coating on the mantle, the tubes are withdrawable in an axial direction from the combustion chamber 4 via holes in its wall. On the outside of the chamber oppositely positioned rollers engage the mantle of the tubes. These rollers 15 are via a transmission 16 driven by a motor 17.

Figure 3:
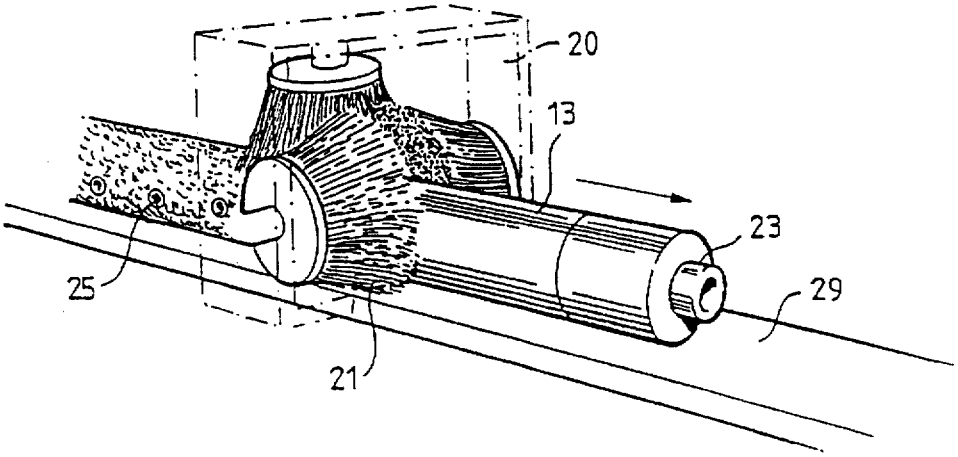
FIG. 3 is a perspective view which to a larger scale shows a feeding apparatus according to the invention associated with a cleaning device.

On a frame 20 there is an arrangement of wire brushes 21, between which the tubes pass when being withdrawn and thereafter inserted. These brushes 21 perform an efficient cleaning of the tubes, so that they are released from dust and slag depositions. FIG. 3 shows the cleaning operation.

It can be seen that the shown arrangement considerably simplifies the cleaning of the tubes and that the tubes can be withdrawn one by one or a few at the same time thereby allowing the combustion process to continue, due to the fact that secondary air is fed via remaining tubes in the combustion chamber.

Alternatively or additionally an automatic shaking device (striking tool or similar, not shown) or acoustic sootblower (infrasonics or ultrasonics) can be connected for continuous or intermittent slag removal.

Should available space not exist on the outside of the combustion chamber the tubes may instead, as indicated by the tube 13', be angled downwards in the combustion chamber and thereafter removed, e.g. manually operated for cleaning outside the combustion chamber.

In the described apparatus the tubes 13 are cooled by the fluid that is used in an actual case. The fed fluid "bleeds through" the tubes and thereby cools them.

Alternatively according to FIG. 2*c* a separate cooling system with an external fluid, e.g. air or water, which is fed via an annular space 46 between the tube 13 and an inner concentric tube 45, can be used. The cooling is thus independent of the fed fluid and/or solid particles for optimization of the combustion process.

Figure 4:
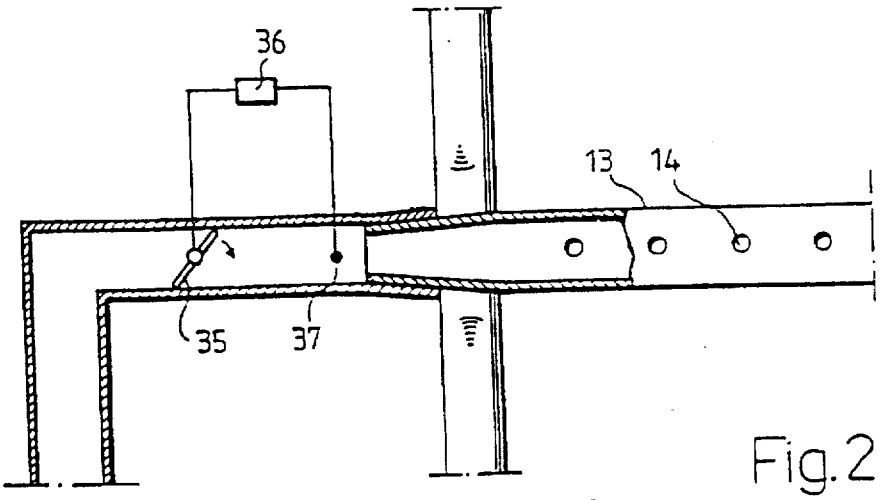
FIG. 4 is a cross-sectional view showing a guide or regulating device for a fluid fed via the apparatus, e.g. secondary air and/or a cooling fluid.

According to FIG. 4 the bleeding of fluid is regulated by a check valve 35, which via a driving device 36 is connected to a sensor 37 in the inner part of the tube. The sensor 37 detects the temperature in the tube and regulates the check valve 35 correspondingly.

The regulation of fluid to each tube 13 can further be made via output signals from transmitters for different gas parameters, gas concentrations, temperatures, pressure, flow etc (not shown). Said transmitters may also be used to, e.g. via a computer, decide when the cleaning or soot removal operations are to be initiated. As mentioned above there is then no need to stop the combustion process.

Alternatively said moments can be decided by a timer.

The material in the tubes 13 is of such a kind that depositions, e.g. in form of ash and unburnt particles, are minimized. The tubes can in some applications be coated with a catalyst, particularly in such cases when a reaction of gases by heterogen catalysis is desired.

When the pressure in the combustion or gasification chamber exceeds 1 bar, the apparatus is preferably equipped with tight bonnets on the outside.

FIG. 1 shows by dashed lines an additional number of tubes 13 at another level via which another fluid or solid particles are fed via a further collecting box 11' shown by dashed lines. The collecting boxes 11 and 11' may be connected to each other via a pipe 40 with a valve 41. Further, the flexible tubes 12 and 12' from respective collecting boxes 11 and 11' are connected via tubes 42, each equipped with a valve 43. In this way the same or different fluids or solid particles can be fed via tubes at different levels via separate or connected tubes, i.e. via a very flexible system.

FIG. 2*d* shows an application where a bundle of tubes 47 for different fluids are contained in an outer tube 13. The feed openings of the tubes 47 are designated 48. The bundle of tubes are disposed within concentric inner tube 45 in order to form a circumferential annular space corresponding to the space 46 in FIG. 2*c* for a cooling fluid.

From the above description it can be concluded that it is particularly important that the area containing the perforations of the tubes can be kept clean and free from depositions.

Feeding of a cooling fluid makes slag and other dust deposition on the tubes of such a type, i.e. less glasslike or adhesive, so that the cleaning operation is simplified and speeded up.

By quick cooling of the tubes, e.g. with liquid nitrogen, a shrinking of the tubes will occur allowing heavy depositions to crack and easily loosen.

In an embodiment not shown on the drawings one or more tubes can be used to maintain more holes, one at a time. Their locations depend on the actual state of the operation of the combustion or gasification chamber. In this case a guide system or similar can be mounted on the outside of the combustion or gasification chamber. Signals from various transmitters initiate the withdrawal, insertion and movement of the tubes with the aid of a driving device to another hole. In this way the combustion or gasification processes in the chamber can be continuously maintained.

With an application according to the invention in a combustion chamber a better combustion result will be achieved with lower concentrations of $NO_x$, CO, $N_2O$, hydrocarbons and unburnt particles as well as dioxine.

A plant with a feeding apparatus according to the invention is easy to install and therefore particularly suitable when converting furnaces, combustion and gasification plants which are operating or already existing on the market.

We claim:

1. A method for enhancing the performance of a combustion plant, comprising the steps of:

a) slidably disposing a plurality of perforated, elongate tubes in a combustion chamber of the plant, b) supplying one of a fluid and solid particles to the chamber through the tubes to support combustion within the chamber, c) selectively axially withdrawing from the chamber and subsequently reinserting back into the chamber at least one of said tubes to control an emission level of a combustion process taking place within the chamber, and d) simultaneously with such withdrawing and reinserting, cleaning an exterior surface of the tube to remove perforation clogging contaminants deposited on said surface by ash or slag-rich fuels.

2. A method according to claim 1, in which the chamber contains a plurality of similar tube groups at different levels, further comprising withdrawing at least two tubes simultaneously, wherein remaining tubes compensate for a fluid supply decrease due to the withdrawn tubes, so as to continuously maintain the combustion process.

3. A method according to claim 2, further comprising using signals from transmitters for at least one of temperature, pressure, flow, and existing flue gas components, to determine initiation of the cleaning step.

4. A method according to claim 3, further comprising using said signals for adjusting the feed of fluid to the tubes.

5. A method according to claim 1 further comprising adding a cooling fluid to the tubes to reduce a temperature of jackets of the tubes to facilitate the cleaning of slag and dust depositions.

6. A method according to claim 5, comprising quickly cooling the tubes pursuant to cleaning to shrink the tubes, making heavy depositions crack and loosen.

7. A combustion plant, comprising:

a) a combustion chamber, b) a plurality of perforated, elongate tubes slidably disposed in the chamber, c) means for supplying one of a fluid and solid particles to the chamber through the tubes to support combustion within the chamber, d) means for selectively axially withdrawing from the chamber and subsequently reinserting back into the chamber at least one of said tubes to control an emission level of a combustion process taking place within the chamber, and e) means for cleaning an exterior surface of the tube, simultaneously with the withdrawal and reinsertion thereof, to remove perforation clogging contaminants deposited on said surface by ash or slag-rich fuels.

8. A combustion plant according to claim 7, further comprising means for regulating the supply of fluid to the chamber, wherein the tubes are connected to a collecting box for said fluid via flexible hoses equipped with quick-couplings and valves.

9. A combustion plant according to claim 7, further comprising driving means for axially withdrawing and reinserting tubes out of and into the chamber, said driving means comprising oppositely positioned driving rollers, arranged at mutual distance, for engaging the tubes, said rollers being driven by a motor via a belt.

10. A combustion plant according to claim 7, further comprising separate tubes concentric with the perforated tubes for feeding a cooling fluid.

11. A combustion plant according to claim 9, wherein the driving means cooperates with a guide system on the outside of the combustion chamber that outputs signals from transmitters to initiate withdrawal, reinsertion, and movement of the tubes to continuously maintain the combustion process in the chamber.

* * * * *